US008695261B2

(12) United States Patent
Troy et al.

(10) Patent No.: US 8,695,261 B2
(45) Date of Patent: Apr. 15, 2014

(54) INSERT GRIPS FOR FIREARM

(75) Inventors: Stephen P. Troy, Lee, MA (US); David A. Hewes, Chesterfield, MA (US)

(73) Assignee: Troy Industries, Inc., West Springfield, MA (US)

( * ) Notice: Subject to any disclaimer, the term of this patent is extended or adjusted under 35 U.S.C. 154(b) by 18 days.

(21) Appl. No.: 13/469,319

(22) Filed: May 11, 2012

(65) Prior Publication Data

US 2012/0311906 A1 Dec. 13, 2012

Related U.S. Application Data

(60) Provisional application No. 61/484,700, filed on May 11, 2011.

(51) Int. Cl.
*F41C 23/00* (2006.01)
*F41C 23/16* (2006.01)

(52) U.S. Cl.
USPC ..... 42/71.01

(58) Field of Classification Search
USPC ..... 42/71.01, 71.02, 72, 73, 74, 106; 294/158, 902; D22/111; 16/421, 430
See application file for complete search history.

(56) References Cited

U.S. PATENT DOCUMENTS

| | | | | | |
|---|---|---|---|---|---|
| 3,815,270 | A * | 6/1974 | Pachmayr | 42/71.02 |
| 4,416,166 | A * | 11/1983 | Jannard et al. | 74/551.9 |
| D275,510 | S * | 9/1984 | McCone | D22/111 |
| 4,674,216 | A * | 6/1987 | Ruger et al. | 42/71.01 |
| 4,833,812 | A * | 5/1989 | Farrar | 42/71.02 |
| 4,967,503 | A * | 11/1990 | Farrar | 42/71.02 |
| D312,563 | S * | 12/1990 | Hillinger | D8/82 |
| D324,478 | S * | 3/1992 | Baer | D8/303 |
| 5,621,997 | A * | 4/1997 | Pearce | 42/71.02 |
| 5,857,279 | A * | 1/1999 | de Oliveira Masina | 42/71.01 |
| 6,860,053 | B2 * | 3/2005 | Christiansen | 42/71.02 |
| 8,141,286 | B1 * | 3/2012 | Saur | 42/74 |
| 2004/0049963 | A1 * | 3/2004 | Christiansen | 42/71.02 |
| 2007/0067960 | A1 * | 3/2007 | Lee et al. | 16/421 |
| 2007/0175077 | A1 * | 8/2007 | Laney et al. | 42/74 |
| 2010/0011905 | A1 * | 1/2010 | Li | 74/551.9 |
| 2011/0258900 | A1 * | 10/2011 | Sims et al. | 42/71.02 |

* cited by examiner

*Primary Examiner* — Bret Hayes
(74) *Attorney, Agent, or Firm* — Parson & Goltry; Robert A. Parsons; Michael W. Goltry

(57) ABSTRACT

An insert grip is used in cooperation with a firearm handguard having a plurality of regularly spaced holes therethrough. The insert grip includes a plurality of tubular flexible inserts, each having a tubular body extending through one of the openings. An upper collar extends radially outwardly around the outer end of the body of each insert. The inserts are affixed together in a regular pattern designed to be coaxial engaged with the holes in the handguard.

21 Claims, 5 Drawing Sheets

INSERT GRIPS FOR FIREARM

CROSS-REFERENCE TO RELATED APPLICATION

This application claims the benefit of U.S. Provisional Patent Application No. 61/484,700, filed 11 May 2011.

FIELD OF THE INVENTION

This invention relates to insert grips for the handguard of firearms.

BACKGROUND OF THE INVENTION

Firearms of the type discussed herein generally include a lower receiver and mating upper receiver. The upper receiver includes a bolt, cartridge insertion and removal mechanism, a firing pin, etc. A barrel is engaged in the front end of the upper receiver and a stock is affixed to the rear end of the lower receiver by some convenient means, such as threading into a rear opening in the lower receiver. A trigger portion of the upper receiver fits into a downwardly directed opening in the lower receiver and is integrated with the internal mechanism of the upper receiver and the lower receiver in a well known manner. A pistol grip is attached to the lower receiver in a well known manner. A magazine or clip assembly (including a clip) is inserted into a downwardly directed opening in the lower receiver for inserting cartridges into the mechanism within the upper receiver in a well known manner. A handguard assembly is affixed to the front end of the upper receiver and surrounds and protects a portion of the barrel. The handguard assembly is also used by the operator to hold and steady the firearm during use.

A major problem with the use of these hand-held firearms of the auto/semi-auto version is that the handguard assembly, even though it may be substantially separated from the barrel, can become extremely hot and very uncomfortable to hold. This in turn can have an effect on the user's accuracy, etc.

It would be highly advantageous, therefore, to remedy the foregoing and other deficiencies inherent in the prior art.

Accordingly, it is an object of the present invention to provide new and improved insert grips for firearms.

It is another object of the present invention to provide new and improved insert grips that do not substantially affect the heat exchange ability of the handguard assembly while adding additional protection to the user against heat.

SUMMARY OF THE INVENTION

Briefly, to achieve the desired objects of the instant invention in accordance with a preferred embodiment thereof, for cooperation with a firearm handguard having a plurality of regularly spaced holes therethrough, an insert grip is provided. The insert grip includes a plurality of tubular flexible inserts, each flexible insert including a tubular body sufficiently long to extend through one of the openings in the handguard assembly. The tubular body of each flexible insert has an outer diameter substantially equal to the inner diameter of the holes through the handguard and defines an insert hole therethrough. Securing structure associated with each flexible insert of the plurality of tubular flexible inserts is designed to firmly secure the plurality of tubular flexible inserts, one each, in a mating handguard hole of the handguard assembly. The plurality of tubular flexible inserts is formed of a heat insulation material so as to insulate a user's hand from the heat of the handguard assembly.

The desired objects of the instant invention are further achieved in accordance with an embodiment of an insert grip for cooperation with a firearm handguard having a plurality of regularly spaced holes therethrough. The insert grip including a plurality of tubular flexible inserts, each flexible insert including a tubular body sufficiently long to extend through one of the openings in the handguard assembly and defining an insert hole therethrough. Each flexible insert includes a laterally extending upper collar extending radially outwardly around the upper or outer end of the tubular body around the periphery of the insert hole and a radially outwardly extending lower flange surrounding the lower or inner end of the tubular body around the periphery of the insert hole. The tubular body of each flexible insert has an outer diameter substantially equal to the inner diameter of the holes through the handguard. The plurality of tubular flexible inserts are affixed together in a regular pattern designed to be coaxial engaged with a like plurality of the regularly spaced holes in the handguard, one each with a mating handguard hole. The upper collar of each tubular flexible insert extends laterally outwardly over an adjacent outer surface of the handguard and the lower flange extends laterally outwardly over an adjacent inner surface of the handguard to hold each flexible insert firmly within the mating handguard hole with the insert hole coaxial with the mating handguard hole. The plurality of tubular flexible inserts are formed of a material sufficiently resilient so that each insert can be flexed or deformed to be engaged in the mating openings, and each flexible insert is formed of a heat insulation material so as to insulate a user's hand from the heat of the handguard assembly.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
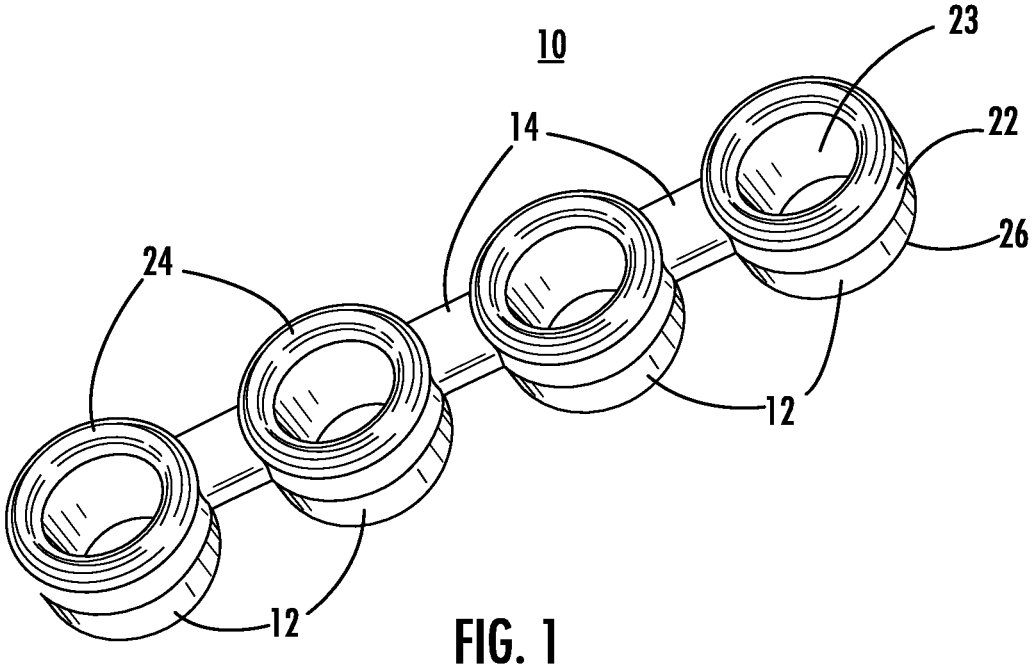
FIG. 1 is a perspective view of an insert grip for the handguard of a firearm in accordance with the present invention.

Turning to FIG. 1 an insert grip 10 designed to be inserted into the handguard of a firearm in accordance with the present invention. In this specific example, insert grip 10 includes a plurality of tubular inserts 12 affixed together in a continuous line by webbing 14. In this example four tubular inserts 12 are affixed together in a line since it has been determined that four are generally sufficiently long to protect the hand of a user from the handguard assembly. However it will be understood that a larger or smaller number of inserts 12 can be affixed together if desired. Also, while the inserts are illustrated herein as extending longitudinally in a line along the handguard assembly because this pattern is the easiest to make and use, it will be understood that the inserts could be formed to extend in a line circumferentially around the handguard assembly, and also in a plurality of parallel lines, or any other regular pattern designed to fit into the holes in the handguard assembly.

Figure 2:
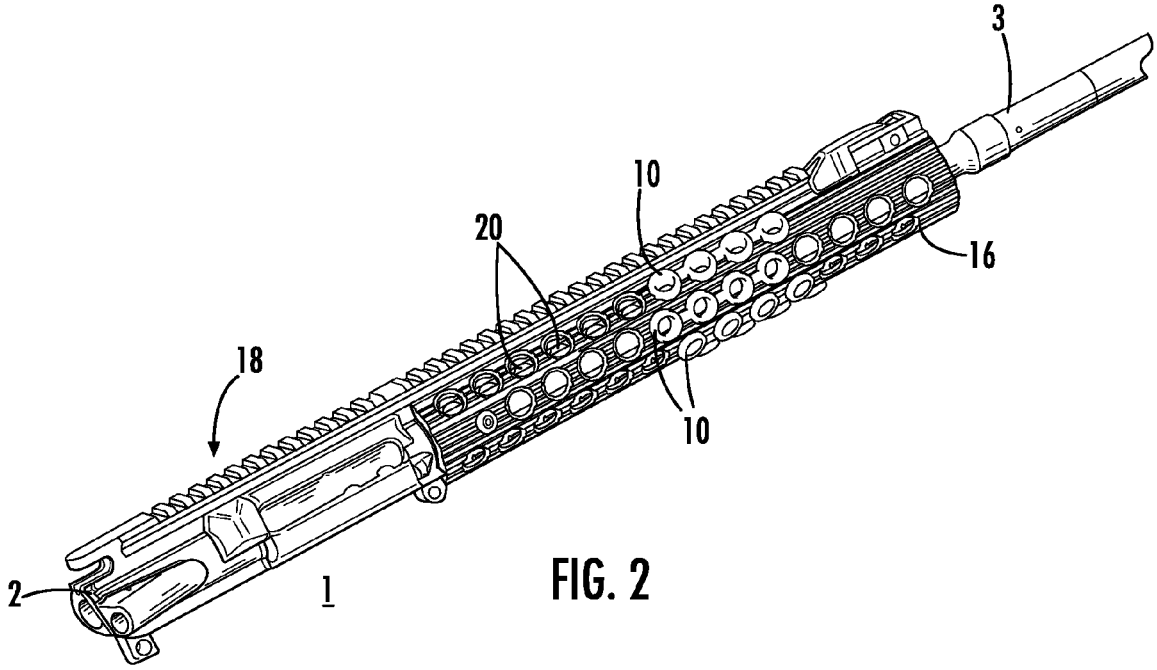
FIG. 2 is a perspective view of the insert grip of FIG. 1, installed in a firearm.

Referring to FIG. 2 a firearm 1 is partially illustrated having an upper receiver 2, which includes a bolt, cartridge insertion and removal mechanism, and a firing pin as known in the art. A barrel 3 is engaged in the front end of upper receiver 2 and a stock and lower receiver (not shown) are connected to upper receiver 2. A pistol grip (not shown) is attached to the lower receiver in a well known manner. A handguard assembly 16 is affixed to the front end of upper receiver 2 and surrounds and protects a portion of barrel 3. As is known in the art, handguard assembly 16 is designed with ribs and holes 20 to allow heat from the barrel to escape to the surrounding atmosphere.

Figure 4:
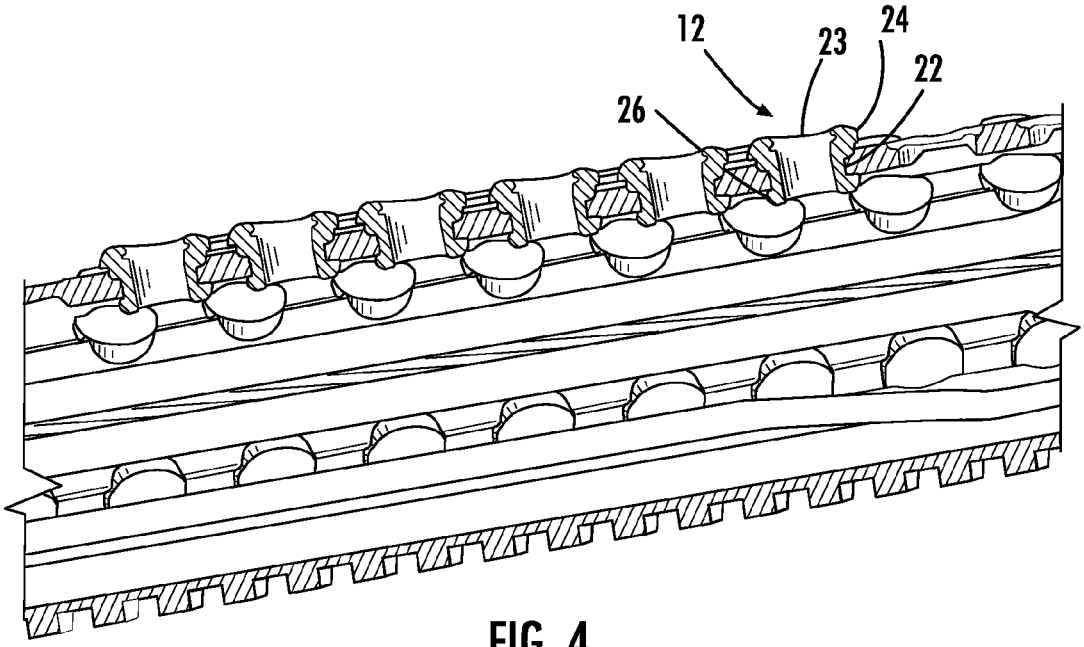
FIG. 4 is a sectional view of the insert grip of FIG. 1 installed on a firearm handguard assembly.

Referring additionally to FIG. 4, it can be seen that insert grips 10 are designed with each insert 12 having a tubular body 22 sufficiently long to extend through one of the openings 20 in handguard assembly 16. Also, some form of securing structure is associated with each insert 12 to hold it securely in an opening of the handguard assembly. Tubular body 22 defines a hole 23 that extends axially through the center thereof. Each insert 12 is formed with a laterally extending upper collar 24 that extends radially outwardly around the upper or outer end of body 22 around the periphery of hole 23. Collar 24 overlies a portion of the outer surface of handguard assembly 16 to provide the major heat protection. Tubular body 22 of each insert 12 is constructed with a minimum cross-section so as to maximize the diameter or area of hole 23 to allow a maximum air flow therethrough. A radially outwardly extending lower flange 26 surrounds the lower or inner end of body 22 and extends outwardly over a portion of the inner surface of handguard assembly 16 to hold each insert 12 and, thus insert grip 10 firmly attached to handguard assembly 16.

Figure 3:
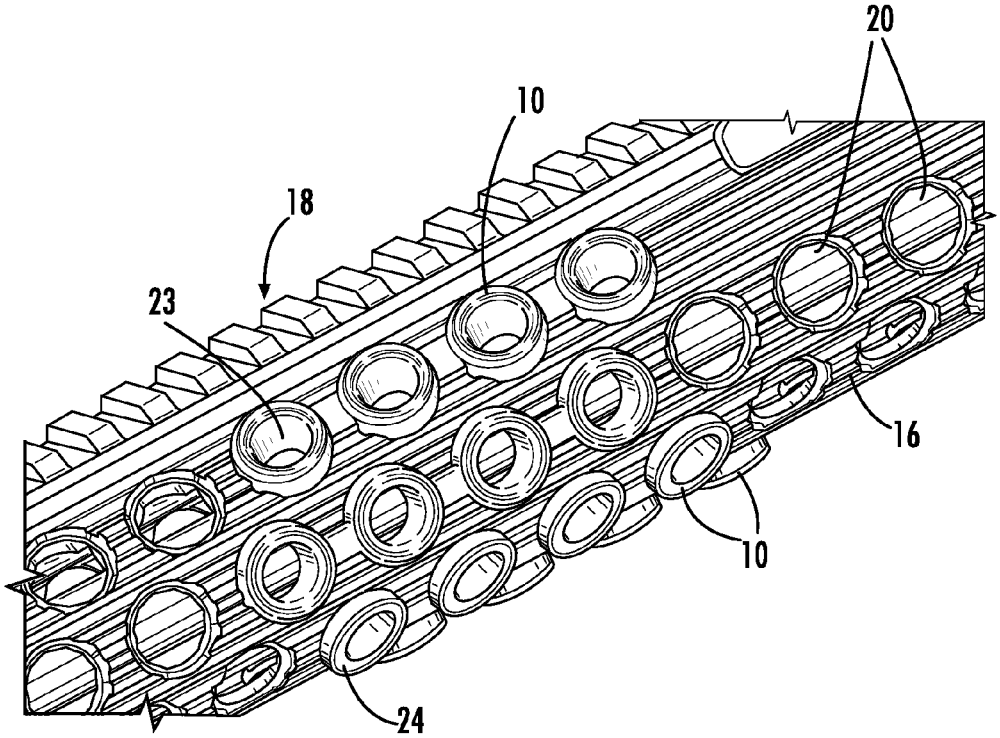
FIG. 3 is an enlarged perspective view of the installed insert grip of FIG. 2.

Referring additionally to FIGS. 2 and 3 a plurality of insert grips 10 are illustrated installed in handguard assembly 16 of firearm 1. Insert grip 10 is formed of an at least slightly resilient material so that each insert 12 can be flexed or deformed as they are pushed into openings 20 in handguard assembly 16. Once properly positioned within openings 20, each insert 12 will return to its normal configuration, with each lower flange 26 engaging the lower surface of handguard assembly 16 around the sides of openings 20 and each upper collar 24 engaging the upper surface of handguard assembly 16 around the sides of openings 20 substantially locking each insert 12 into an opening 20. Thus, in this specific embodiment upper collar 24 and lower flange 26 serve as the securing structure but it will be understood that various modifications could be incorporated, such as partial or sectioned collars and/or flanges.

Each insert 12 has a hole 23 therethrough so that even when a plurality of insert grips 10 are installed in openings 20 of handguard assembly 16 escape of heat from the barrel is only slightly obstructed. Also, insert grips 10 are formed of a heat insulation material so as to insulate a user's hand from the heat of the handguard assembly. In this preferred embodiment insert grip 10 is formed of rubber but other materials, such as a partially flexible insulating plastic or the like can be used.

Insert grip 10 is specially designed so that a firearm owner/user can install insert grips 10 around the periphery of handguard assembly 16 (as illustrated in FIGS. 2 and 3) so as to provide a sufficiently extensive grip for the user's hand. Also, because insert grips 10 are easily installed, removed, or moved, the user can easily place a number of insert grips 10 around the periphery of handguard assembly 16 at the precise longitudinal location along handguard assembly 16 that will provide the best heat protection while providing the best balance for using the firearm.

Figure 5:
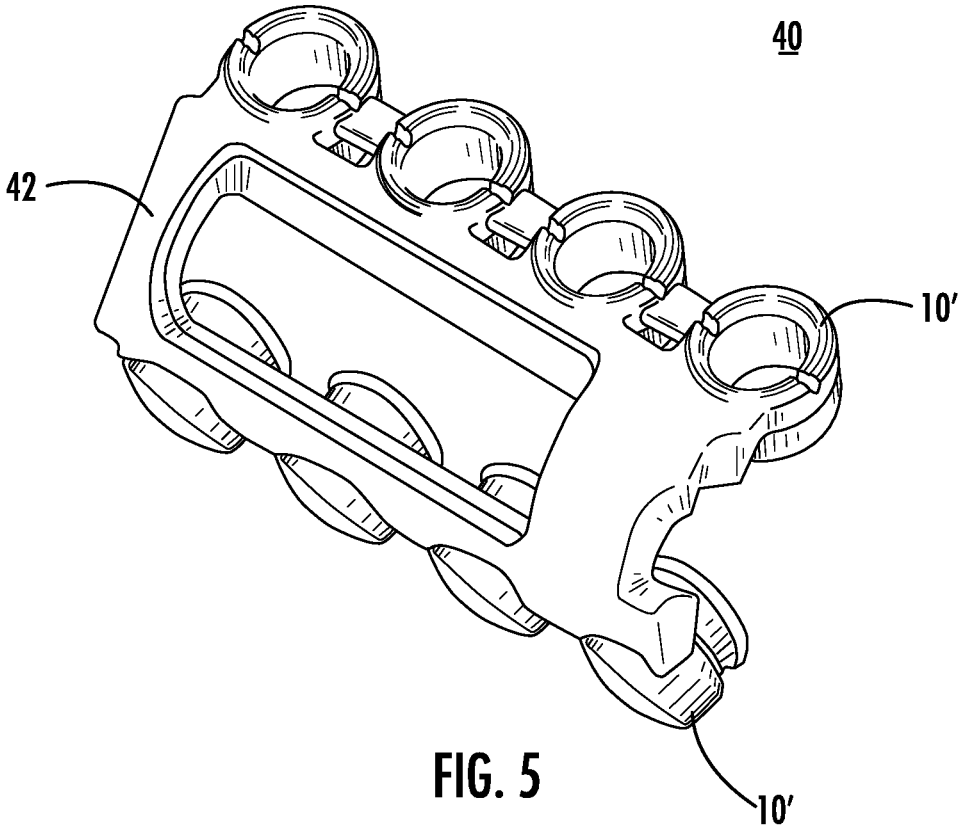
FIG. 5 is a perspective view of a modified insert grip for a firearm in accordance with the present invention.
Figure 6:
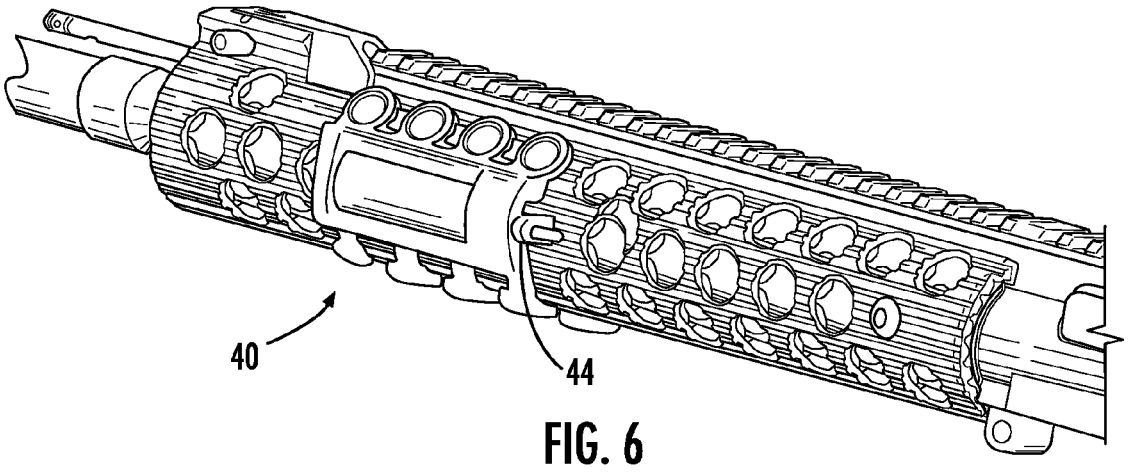
FIG. 6 is a perspective view of the modified insert grip of FIG. 5, installed on a firearm handguard assembly.
Figure 7:
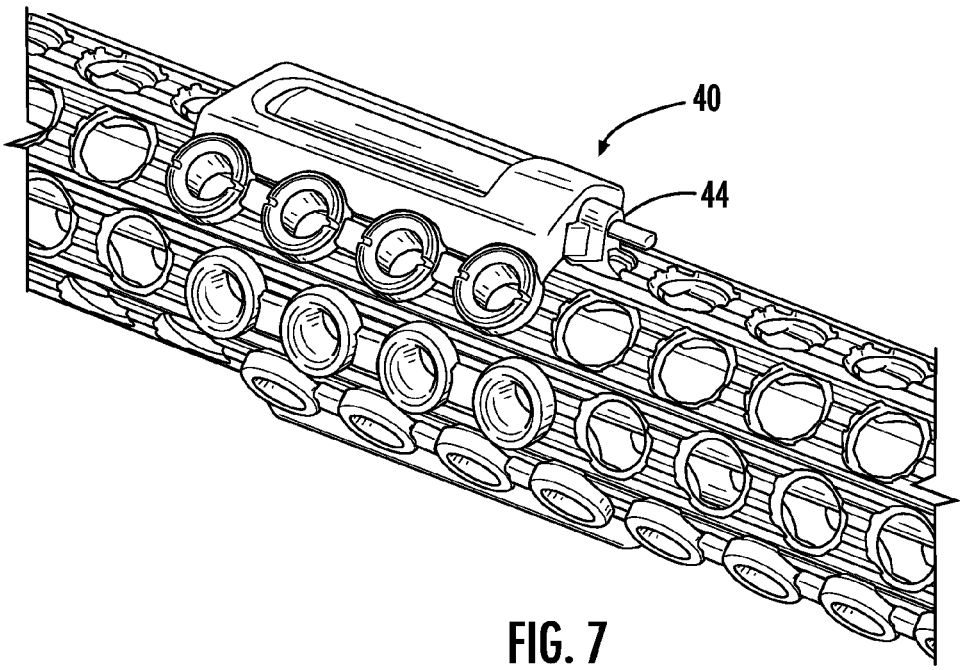
FIG. 7 is an enlarged perspective view of the modified insert grip of FIG. 5 in conjunction with the insert grip of FIG. 1 installed on a firearm handguard assembly.

Turning now to FIGS. 5, 6, and 7, a modification to the insert grip is illustrated. In this example, the modification is a mounting structure 40 that can be used to mount electrical switches or virtually any other auxiliary item that might be used in conjunction with firearm 1. Mounting structure 40 basically includes structure similar to a pair of insert grips 10 (herein designated 10') and connecting support elements 42 coupling and positioning insert grips 10' so as to be aligned with adjacent rows of openings 20 in handguard 16. In this preferred embodiment insert grips 10' and connecting support elements 42 are formed as an integral unit using any convenient method, such as molding or the like. Also, electrical or optical communications apparatus, illustrated in FIG. 7 and designated 44 may be provided in connecting support elements 42 if convenient. Mounting structure 40 can be easily and conveniently attached to the outer surface of handguard assembly 16 and may, for example, form a portion of the grip (see especially FIG. 7) that protects the user's hand from the heat of the handguard assembly 16. In this fashion switches or the like that are mounted within the opening formed by connecting support elements 42 are readily accessible to the hand of the user that is gripping the combined mounting structure 40 and insert grips 10.

Figure 8:
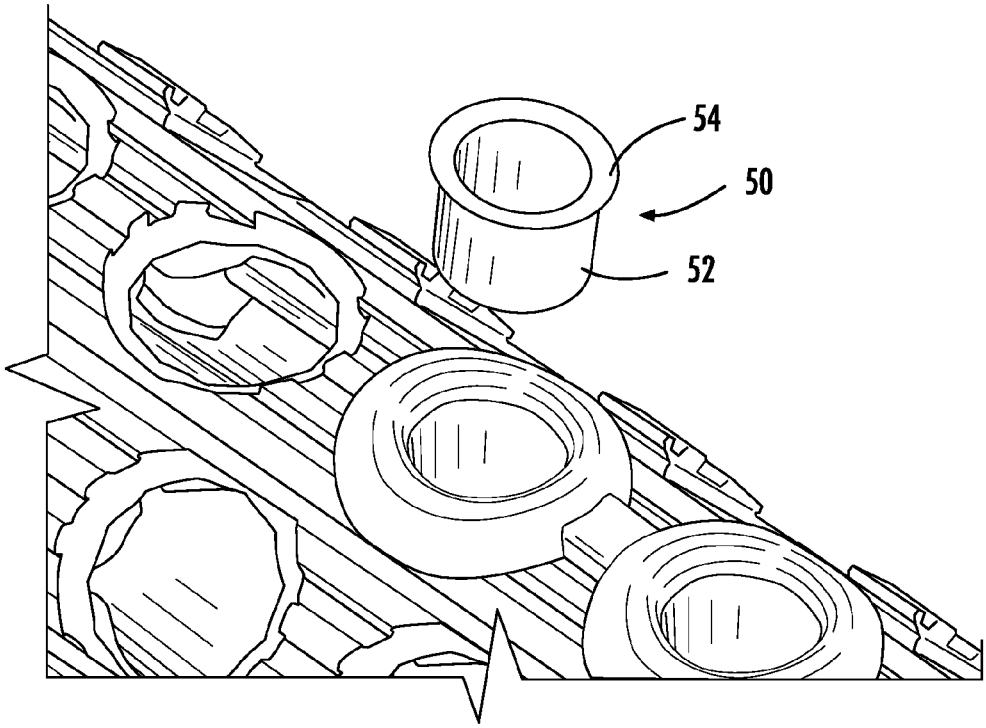
FIG. 8 is an exploded view of another modification to the insert grip of FIG. 1 as installed on a firearm handguard assembly.
Figure 10:
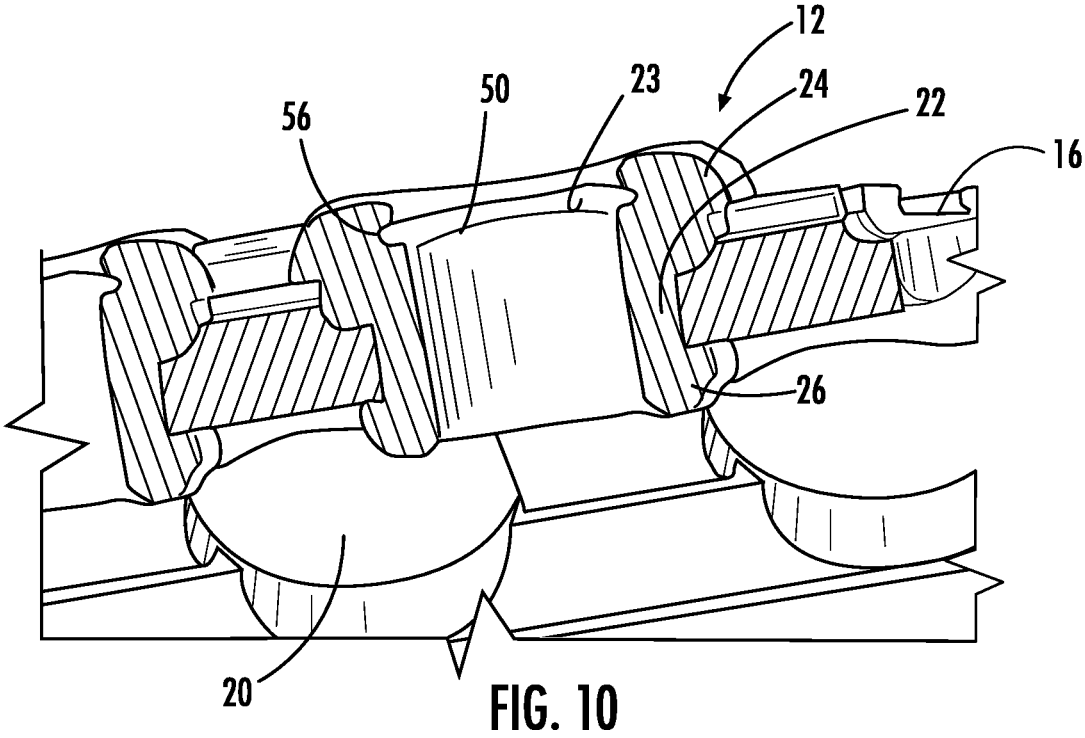
FIG. 10 is an enlarged sectional view similar to FIG. 9 illustrating the modification component installed in the insert grip of FIG. 1.
Figure 9:
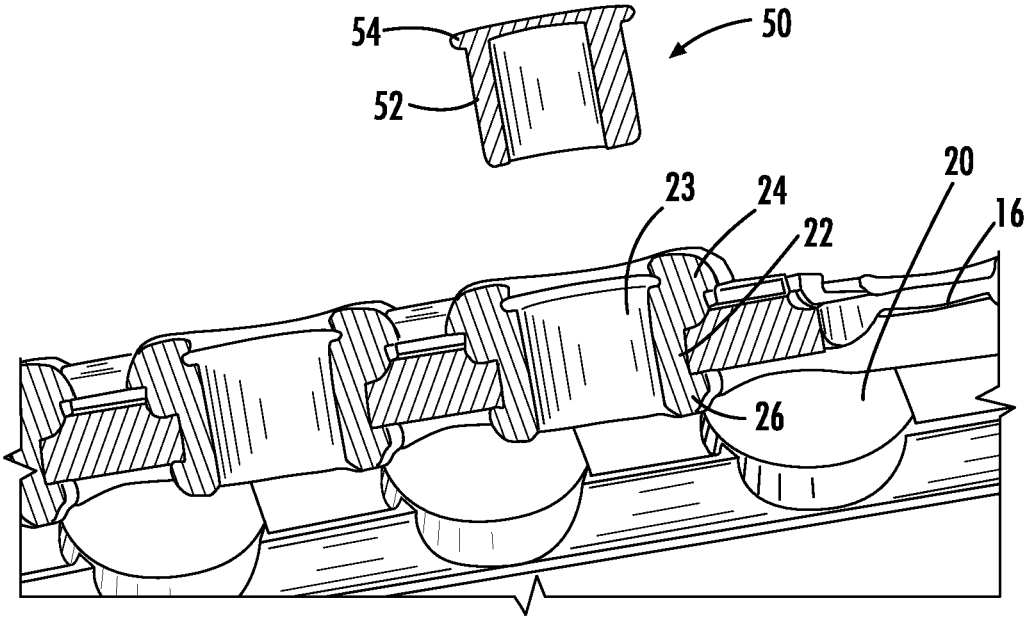
FIG. 9 is a sectional view as seen generally from a line cut longitudinally through the modified insert of FIG. 8.

Turning now to FIGS. 8, 9, and 10 another modification of insert grips 10 is illustrated. In this modification a firmer tubular insert 50 is provided as a further support for insert grips 10. In some specific applications it may be desirable or expedient to form insert 12 of insert grip 10 from a relatively thin and flexible material. Alternatively, it may be desirable to form body 22 with a very minimum cross-section so as to further maximize the diameter or area of hole 23. In such instances inserts 12 may not hold insert grip 10 sufficiently tightly within openings 20 so that there is some danger of a user losing their grip on the firearm. To forego this possibility firmer tubular locking inserts 50 may be provided and inserted as illustrated.

Tubular locking insert 50 is formed of a firmer or rigid plastic or the like and includes a tubular body 52 with a radially outwardly extending flange 54 at the upper edge. In the specific embodiment illustrated, the outer diameter of tubular body 52 is substantially the same as the inner diameter of hole 23 in each insert 12 of insert grip 10. Further, in this specific embodiment each insert 12 is formed with a radially outwardly extending groove 56 extending peripherally around hole 23 and spaced a small distance from the upper edge. Groove 56 is positioned to receive flange 54 of tubular insert 50 when tubular insert 50 is inserted coaxially into hole 23 of insert 12. Thus, the stiffer tubular locking insert 50 is positioned coaxially within hole 23 and held in place by flange 54 engaged in groove 56. Since tubular locking insert 50 is stiffer than flexible insert 12, it locks inserts 12 and, thus insert grips 10, firmly engaged in openings 20 of handguard assembly 16 with no danger of being inadvertently disengaged.

It will be noted that the combination of an insert 12 with a body 22 having a minimum cross section and a very thin tubular locking insert 50 can be formed with a total cross-section that is thin enough to allow maximum transfer of cooling air through handguard assembly 16 while providing maximum safety against an inadvertent removal or disassembly of insert grips 10 from handguard assembly 16. While the specific embodiment illustrated includes flange 54 on stiff tubular locking insert 50 and groove 56 in flexible insert 12 as an anchoring structure, it should be understood that other anchoring structures might be used to hold the stiff tubular locking insert within the flexible insert, such as a rough or stippled outer surface on the stiff tubular insert.

Thus, a new and improved insert grip is illustrated and described. The new and improved insert grip is designed to provide a user with a more stable grip on the handguard assembly and to protect the user's hand from the heat of the handguard assembly. The improved insert grip is designed to be easily and conveniently installed on the outer surface of the handguard assembly of any firearm. Further, the improved insert grip can be easily installed at an optimum position (longitudinally along the length of the handguard assembly) for each specific user of a firearm. Also, the improved insert grip is relatively inexpensive and can be quickly and easily changed as needed.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. In cooperation with a firearm handguard mounted to an upper receiver of a firearm and at least partially encircling a barrel thereof, the handguard having a plurality of regularly spaced air flow holes therethrough, an insert grip comprising:

a plurality of tubular flexible inserts, each flexible insert including a tubular body sufficiently long to be extendable through one of the air flow holes in the handguard, the tubular body of each flexible insert having an outer diameter substantially equal to the inner diameter of the air flow holes through the handguard and defining an insert hole therethrough;

securing structure associated with each flexible insert of the plurality of tubular flexible inserts for firmly securing the plurality of tubular flexible inserts, one each, in a mating air flow hole of the handguard assembly; and the plurality of tubular flexible inserts being formed of a heat insulation material so as to insulate a user's hand from the heat of the handguard.

2. The insert grip of claim 1 further including structure affixing the plurality of tubular flexible inserts together in a regular pattern designed to be coaxially engagable with a like plurality of regularly spaced air flow holes in the handguard, one each with a mating handguard air flow hole.

3. The insert grip of claim 2 wherein the plurality of tubular flexible inserts affixed together in the regular pattern include at least four flexible inserts affixed together with a flexible webbing.

4. The insert grip of claim 3 wherein the plurality of tubular flexible inserts and the flexible webbing are a continuous integral unit.

5. The insert grip of claim 1 wherein the plurality of tubular flexible inserts are formed of a material sufficiently resilient so that each insert can be flexed or deformed to be engaged in the mating openings.

6. The insert grip of claim 5 wherein the securing structure includes a collar extending laterally outwardly adjacent the upper or outer end of the tubular body and a flange extending laterally outwardly adjacent the lower or inner end of the tubular body of each tubular flexible insert of the plurality of tubular flexible inserts.

7. The insert grip of claim 1 including in addition a like plurality of tubular locking inserts each with a tubular body having an outside diameter substantially equal to the inside diameter of the tubular body of the flexible inserts, and anchoring structure removably positioning the locking inserts, one each, coaxially within the mating flexible insert when positioned in a mating handguard air flow hole so as to lock the flexible insert within the mating handguard air flow hole.

8. The insert grip of claim 7 wherein the locking insert is formed of a material stiffer than the material of the flexible insert.

9. The insert grip of claim 7 wherein the anchoring structure includes a radially outwardly extending flange adjacent the upper edge of each locking insert and a mating radially outwardly extending groove extending peripherally around the insert hole and spaced from the upper edge of the flexible insert.

10. The insert grip of claim 7 wherein the anchoring structure includes a rough or stippled outer surface on the tubular body of the locking insert.

11. A firearm handguard and an insert grip comprising:

a firearm handguard mounted to an upper receiver of a firearm and at least partially encircling a barrel thereof, the handguard having a plurality of regularly spaced air flow holes therethrough;

a plurality of tubular flexible inserts, each flexible insert including a tubular body sufficiently long to extend through one of the air flow holes in the handguard and defining an insert hole therethrough, each flexible insert including a laterally extending upper collar extending radially outwardly around the upper or outer end of the tubular body around the periphery of the insert hole, and a radially outwardly extending lower flange surrounding the lower or inner end of the tubular body around the periphery of the insert hole, the tubular body of each flexible insert having an outer diameter substantially equal to the inner diameter of the holes through the handguard;

the plurality of tubular flexible inserts affixed together in a regular pattern designed to be coaxial engaged with a like plurality of regularly spaced air flow holes in the handguard, one each with a mating handguard air flow hole, the upper collar of each tubular flexible insert extending laterally outwardly over an adjacent outer surface of the handguard and the lower flange extending laterally outwardly over an adjacent inner surface of the handguard to hold each flexible insert firmly within the mating handguard air flow hole with the insert hole coaxial with the mating handguard air flow hole; and the plurality of tubular flexible inserts being formed of a material sufficiently resilient so that each insert can be flexed or deformed to be engaged in the mating air flow holes, and each flexible insert being formed of a heat insulation material so as to insulate a user's hand from the heat of the handguard.

12. The insert grip of claim 11 wherein the tubular flexible inserts affixed together in the regular pattern are affixed together in a line designed to extend longitudinally along the axial length of the handguard.

13. The insert grip of claim 11 wherein the sufficiently resilient material of the tubular flexible inserts includes one of rubber and resilient plastic.

14. The insert grip of claim 11 wherein the plurality of tubular flexible inserts affixed together in the regular pattern include at least four flexible inserts affixed together with a flexible webbing.

15. The insert grip of claim 14 wherein the plurality of tubular flexible inserts and the flexible webbing are a continuous integral unit.

16. The insert grip of claim 11 including a first plurality of tubular flexible inserts affixed together in a first line, a second plurality of tubular flexible inserts affixed together in a second line, and connecting support elements coupling the first and second lines together in a spaced apart relationship and positioning the first and second lines so as to be aligned with different rows of air flow holes in the handguard.

17. The insert grip of claim 16 wherein the support elements are designed to mount one or more auxiliary items between the first and second lines.

18. The insert grip of claim 11 including in addition a like plurality of tubular locking inserts each with a tubular body having an outside diameter substantially equal to the inside diameter of the tubular body of the flexible inserts, and anchoring structure removably positioning the locking inserts, one each, coaxially within the mating flexible insert positioned in a mating handguard hole so as to lock the flexible insert within the mating handguard hole.

19. The insert grip of claim 18 wherein the locking insert is formed of a material stiffer than the material of the flexible insert.

20. The insert grip of claim 18 wherein the anchoring structure includes a radially outwardly extending flange adjacent the upper edge of each locking insert and a mating radially outwardly extending groove extending peripherally around the insert hole and spaced from the upper edge of the flexible insert.

21. The insert grip of claim 18 wherein the anchoring structure includes a rough or stippled outer surface on the tubular body of the locking insert.

* * * * *